United States Patent [19]

Rose et al.

[11] 4,337,545

[45] Jul. 6, 1982

[54] BRIDGES FOR PROVIDING ACCESS FROM A WATER-BORNE CRAFT TO THE SHORE

[76] Inventors: John Rose, 22 Royal Crescent, Glasgow G3 7SL; James S. Pearson, 8 Burnside Ave., Kirkintilloch, both of Scotland

[21] Appl. No.: 103,706

[22] Filed: Dec. 14, 1979

[30] Foreign Application Priority Data

Dec. 15, 1978 [GB] United Kingdom ..... 48700/78

[51] Int. Cl.[3] ..... E01D 1/00

[52] U.S. Cl. ..... 14/71.1; 405/220; 405/219; 114/230; 114/263; 14/27

[58] Field of Search ..... 14/69.5, 71.1, 27; 9/1.6; 114/263, 45, 230, 125, 231; 405/220, 221

[56] References Cited

U.S. PATENT DOCUMENTS

| | | | |
|---|---|---|---|
| 76,807 | 4/1868 | Wilson | 14/71.1 |
| 579,813 | 3/1897 | Wylie | 14/71.1 X |
| 785,400 | 3/1905 | Buchanan | 14/71.1 X |
| 2,617,131 | 11/1952 | Harris | 14/71.1 |
| 2,641,785 | 6/1953 | Pitts | 14/71.1 |
| 2,759,331 | 8/1956 | Fiebinger | 114/263 X |
| 2,976,694 | 3/1961 | Stanford | 14/71.1 X |
| 3,004,391 | 10/1961 | Miller | 14/71.1 X |
| 3,145,854 | 8/1964 | Sturm | 14/71.1 X |

FOREIGN PATENT DOCUMENTS

| | | | |
|---|---|---|---|
| 1516220 | 3/1968 | France | 114/263 |

*Primary Examiner*—Nile C. Byers, Jr.
*Attorney, Agent, or Firm*—Karl F. Milde, Jr.

[57] ABSTRACT

A ship to shore bridge is movable between a stowed position in which it is received in a recess formed in a quay face and effectively forms a continuation of the quay face along the length of the recess, so that the quay can be used in normal manner, and an operative position in which the ship end of the bridge is moved out of the recess by slewing of the bridge about its shore end, so that the bridge can provide access from the quay to a bow or stern door of a ship berthed alongside the remainder of the quay.

11 Claims, 14 Drawing Figures

BRIDGES FOR PROVIDING ACCESS FROM A WATER-BORNE CRAFT TO THE SHORE

This invention relates to bridges of the kind comprising a bridging beam affording an access track from a water-borne craft to the shore, the beam being supported at its shore end by a pivotal connection which has a capability of permitting the beam at least to hinge around a substantially horizontal axis to enable the other end of the beam to rise or fall. Such a bridge will be referred to hereafter as a ship to shore bridge of the type specified, although it will be clear that it can be used to provide access to water-borne craft other than ships, for example hovercraft.

One example of this type of bridge is known as a linkspan, a part of the load of the bridging beam and traffic thereon being taken adjacent the ship end by means of a buoyancy tank or tanks secured to the underside of the bridging beam. In some cases, the buoyancy of this tank or tanks is capable of adjustment by varying the volume of air therein, for example by means of a compressor and a venting valve. In a particularly convenient form of this type of bridge, the buoyancy tank or tanks are connected to the bridging beam by a tank leg or legs which are of fairly slender cross-section, in comparison with the plan area of the tank or tanks. With such an arrangement, a small adjustment of the buoyancy of the tank or tanks will be sufficient to shift the ship end of the bridging beam vertically to match the freeboard of a ship preparing to berth. Also, it is possible to link the ship end of the bridging beam to the ship, so that the end of the beam rises and falls with changes in the freeboard of the ship; although this will produce some change in the displacement of the buoyancy-providing structure of the bridge, the slenderness of the tank legs will mean that this change in displacement, and the corresponding change in buoyancy, will be minimal. The ship end of the bridge can therefore be partially borne by, for example, being hooked on to the ship, or by being suspended from the ship by means of one or more cables, without introducing the possibility of a large increase in the load on the hook or cables if the freeboard of the ship should increase, or if the relative vertical positions of the ship and the buoyancy tank should try to change owing to wave action.

An incidental advantage of such an arrangement of buoyancy tanks and tank legs is that the buoyancy-producing structure, being almost entirely immersed, is little affected by wave action.

Such ship to shore bridges are well known and are commonly used in association with roll-on roll-off ferries, for example, having stern doors with the interposition of either one or more stern ramps carried by the ship or a number of retractable flaps carried by the bridging beam itself.

Such bridges are capable of limited adjustment either by translational movement along the pivotal connection or by a slewing through a relatively small angle at the pivotal connection in order to adjust the position of the bridging beam at its end adjacent the ship to cater for ships of varying width and stern door position.

According to one aspect of the present invention, a ship to shore bridge of the type specified is characterised in that the bridging beam is mounted on a shore, quay or the like for movement between a stowed condition in which it is substantially or completely received in a recess in the quay edge and an operative condition in which at least the ship end of the beam is displaced from the recess. This may be achieved by slewing the bridging beam about its shore end, the slewing being carried out by slewing means, for example, a hydraulic piston and cylinder or a mechanical slewing means such as a rack and pinion. Where the pivotal connection comprises a circular cross-section bar or tube member cooperating with a planar member, one of these members may be permanently located in the recess, while the other member is secured to the underside of the bridging beam, and rests on the fixed member. The bridging beam may then be slewed relative to the fixed member when being moved between its operative and stowed conditions and vice versa. Advantageously, the member secured to the bridging beam may be the circular cross-section bar or tube; with this arrangement, the pivoting axis of the connection remains square to the length of the bridge, even when the bridge is slewed. Alternatively, the circular cross-section bar, may be fixed to the quay; in this case the circular cross-section bar may be fixed slewed with respect to the quay, particularly where the slewing angle required in moving the beam between its stowed and operative positions is fairly large.

Desirably, the upper surface of the bridging beam, in the stowed condition, is flush with the remainder of the quayside and, together with any flaps or ramps at each end of the beam, may permit normal traffic along the quayside over the beam. In addition, where the quayside carries cranes on fixed rails extending the length of the quayside, one of these rails may be partially formed in the upper surface of the bridging beam, appropriate connections with the remainder of the rail on the quayside being provided at the ends of the beam.

According to a particular arrangement, the ship end of the beam, when stowed in the recess, is supported by a ledge or other support means located in the recess.

The invention may be carried into practice in a number of ways but one specific embodiment will now be described by way of example with reference to the accompanying drawings, in which.

Figure 10:
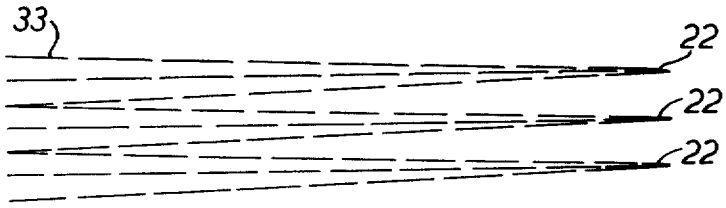
Figure 11:
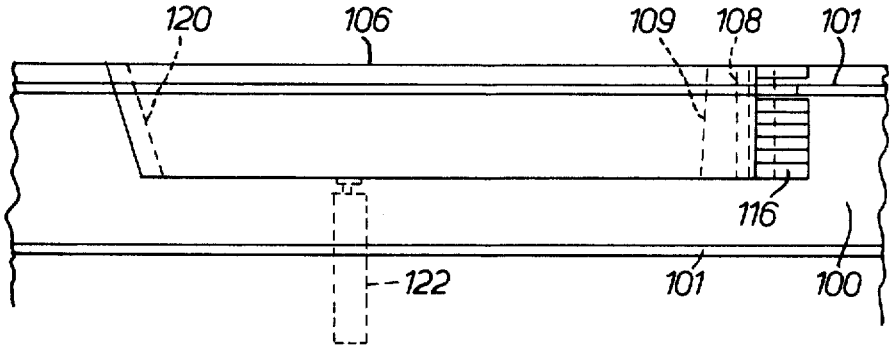
Figure 13:
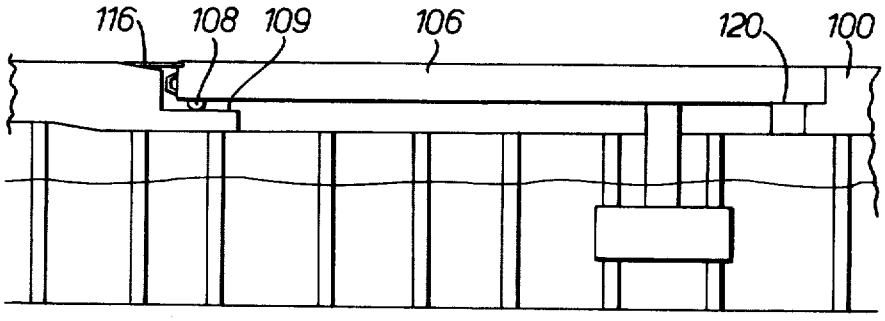
Figure 12:
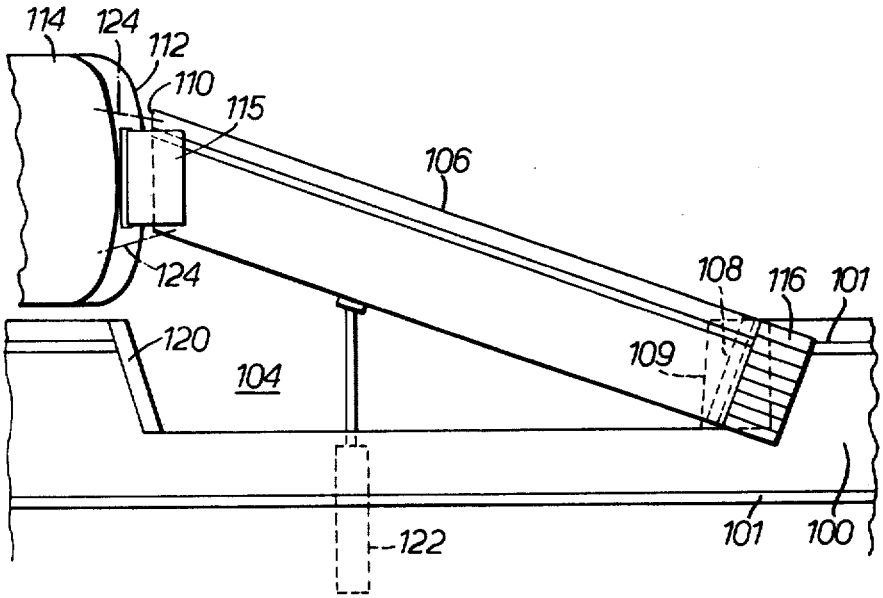

FIG. 10 diagramatically illustrates the range of positions which the bridge can occupy by either translational movement of the shore end of the bridge and/or slewing at that end;

FIG. 11 is a plan view of a portion of a quayside incorporating a ship to shore vehicular bridge according to the present invention;

FIG. 12 shows the arrangement of FIG. 11 in an extended condition and showing the bridge linking a quay to a ship having a stern ramp;

FIG. 13 is an elevation of the quayside of FIGS. 11 and 12; and

Figure 14:
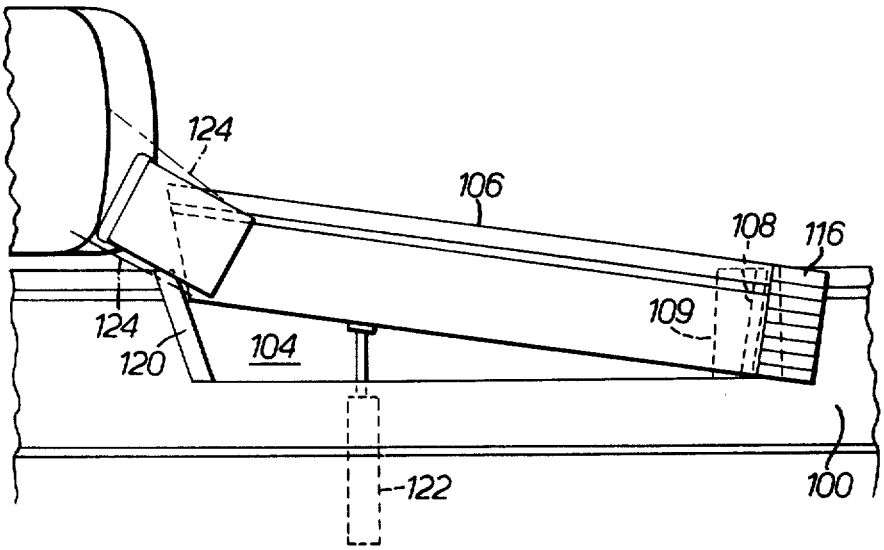

FIG. 14 is a plan view, similar to FIG. 12, but showing the bridge linking the quay to a ship having a quarter ramp.

Figure 1:
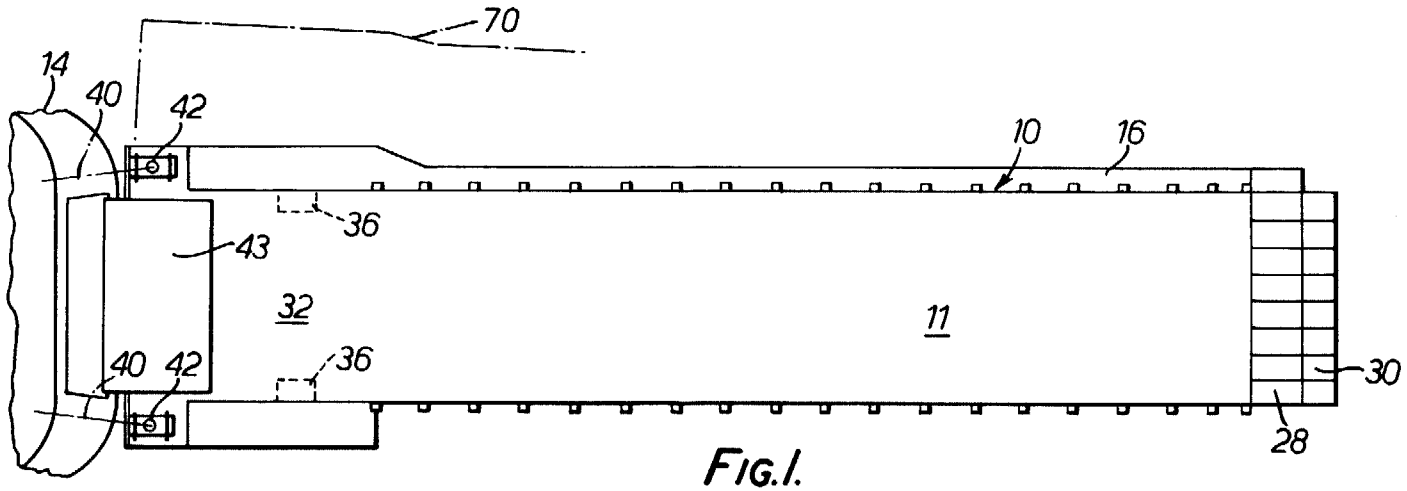
FIG. 1 is a plan view of a known ship to shore vehicular bridge.
Figure 2:
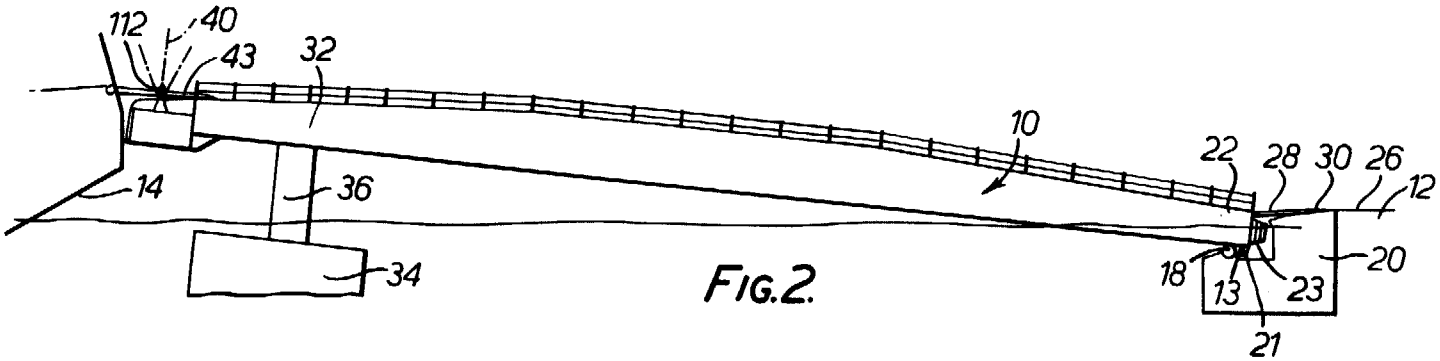
FIG. 2 is a side elevation of the bridge of FIG. 1 shown connecting the shore to a ship.

In order that the embodiment of the invention can be fully understood, a description will first be provided of a conventional bridge by way of reference to FIGS. 1 to 10. Thus, FIG. 1 shows a vehicular bridge generally indicated at 10 which is constructed as an elongated box-like structure having a main upper deck 11 over which traffic can pass between a shore end of the bridge shown at the right hand side in FIGS. 1 and 2 to the ship end shown at the left hand side in FIGS. 1 and 2. In FIG. 2, the bridge is shown bridging a gap between a shore 12 and a ship 14. In addition to the deck 11 for vehicles, a pedestrian track 16 is provided along one edge of the bridge. At its shore end, the bridge rests on a tubular support 18, rigidly mounted in a structure 20, built into the shore 12. As is conventional, the shore end 22 of the bridge 10 merely rests on the tubular support 18 which in effect provides a fulcrum for rotational movement of the bridge 10 about a horizontal axis to accommodate changes in tide and freeboard of ship.

A downwardly-projecting bracket 21 on the underside of the bridge 10 prevents the bridge from moving away from the shore off the support 18; a rubber buffer 13 is fitted to the left-hand face (as seen in FIG. 2) of the bracket 21, and abuts against the support 18 if the bridge should tend to make such a movement. A further rubber buffer 23 is mounted on the end face of the shore end of the bridge 10; if the bridge should be subjected to an endways impact by a ship as the ship berths, the buffer 23 will abut against the fixed structure 20 to bear this load, without stressing the tubular support 18. Brackets (not shown) are also provided to prevent the shore end of the bridge 10 from lifting away from the support 18 if such an impact should occur. The shore end of the track 11 of the bridge is connected to a roadway 26 on the shore by means of hinged flaps 28 and 30. The ship end 32 of the bridge is supported by a buoyancy tank 34 connected to the bridge by a pair of buoyant legs 36. When no ship is berthed at the ship end of the bridge, the buoyancy tank 34, together with the buoyant legs 36, provides the only support for the ship end of the bridge. The tank 34 is made of such a size that, when completely empty of water, its buoyancy is more than sufficient to support the ship end of the bridge. Internally, the buoyancy tank 34 is divided into water-tight compartments, and to allow the buoyancy of the tank to be adjusted, and thereby raise or lower the ship end of the bridge, one of these compartments is open-bottomed, so that it can be controllably flooded. Means is provided, but not shown, for admitting air under pressure to the open-bottomed compartment, to expel water from the compartment and thereby raise the ship end of the bridge, and for releasing air from the compartment, to allow the compartment to become more flooded and thereby lower the ship end of the bridge.

In this way, the bridge can be adjusted to match the freeboard of a ship which is about to berth. Normally, the buoyancy tank 34 is completely immersed, so that only the small cross-section of the buoyant legs 36 breaks the surface. This means that the height of the ship end of the bridge can be adjusted by only a small change in the buoyancy of the tank 34, but it also means that the bridge would sink considerably as soon as any appreciable load were applied to it, if no other means of support were provided.

When the bridge is actually in use for loading or unloading a ship, both the weight of the bridge and the weight of any traffic on it has to be supported. The buoyancy tank 34 and the buoyant legs 36 continue to support a part of this combined load, while the remainder of the load is borne at the ship end by the ship itself by means of a pair of cables or chains or other flexible elements 40 which are connected to the ship end 32 of the bridge by means of gimbal mounted support cylinders 42 arranged automatically to take up or let out lengths of cable or chain in order to support the bridge equally on both edges irrespective of roll or list of the ship. After the cables or chains 40 have been connected during berthing operations, the buoyancy of the tnak 36 is reduced slightly, to ensure that the cables 40 do not become slack, even when there is no traffic on the bridge.

As can be seen from FIGS. 1 and 2, the ship has a stern ramp 43 which is lowered on to the deck of the bridge to allow vehicular access into the ship. The ramp 43 is sufficiently narrow that it does not obstruct the cables or chains 40. There are a number of alternative ways of connecting the deck of the bridge to the ship itself and these will be discussed in relation to FIGS. 4 to 10.

Figure 4:
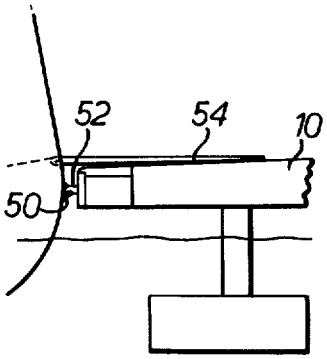
FIG. 4 shows an alternative method of connection of a bridge to a ship in which the ship end of the bridge is hooked onto the ship in a case where a very wide ship's ramp is employed.
Figure 5:
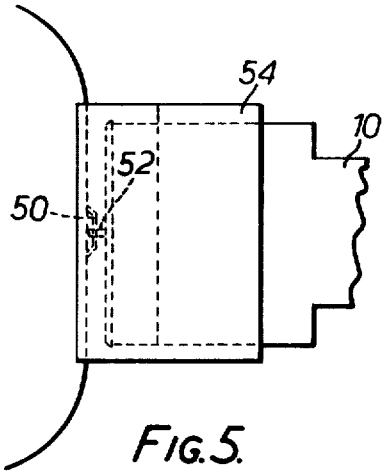
FIG. 5 is a plan view of the arrangement of FIG. 4.

In FIGS. 4 and 5 a bracket 50 is provided at the stern of the ship which is engaged by a hook 52 on the ship end of the bridge 10. In this case, the ship is provided with a very wide ramp 54 which is wider than the ship end of the bridge 10, so precluding the possibility of utilising the cables or other suspension-type supports from the ship. Such a bracket and hook arrangement could, of course, be used with the narrower ramp of FIGS. 1 and 2.

Figure 6:
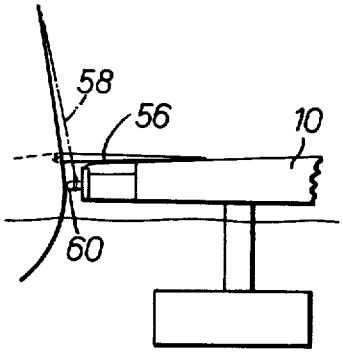
FIG. 6 shows an alternative method of connecting the ship end of a bridge to a ship in the case where a double ship's ramp is employed.
Figure 7:
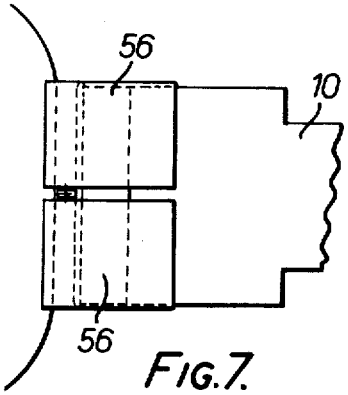
FIG. 7 is a plan view of the arrangement of FIG. 6.

FIGS. 6 and 7 illustrate an arrangement in which the ship has a double ramp 56 permitting a single or double cable 58 to pass between the ramps to engage a hook 60 on the end of the bridge.

Figure 8:
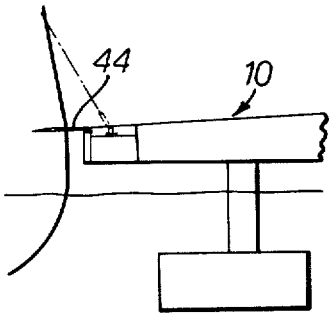
FIG. 8 shows a further arrangement where the ship end of the bridge is supported by a pair of cables from a ship with no stern ramp.
Figure 9:
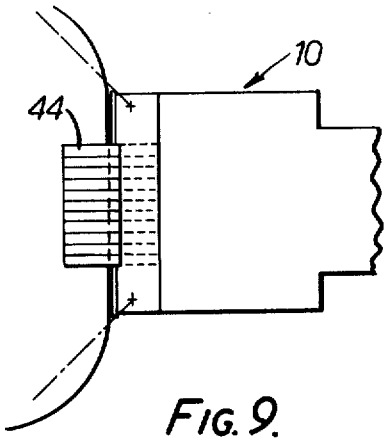
FIG. 9 is a plan view of the arrangement of FIG. 8.

FIGS. 8 and 9 illustrate a ship which has no ramp. The gap between the end of the bridge deck and the ship is in this case bridged by a series of retractable flaps 44 carried by the bridge. When the flaps 44 are not required, as when handling a ship which has a ramp, they can be retracted beneath the end portion of the roadway formed on top of the bridge. With such an arrangement, the bridge can be used to handle ships both with and without ramps.

FIG. 10 diagramatically illustrates the manner in which the ship end 32 of a bridge can be translationally moved from a mean position to either of two extreme positions simply by sliding the shore end 22 of the bridge along the tube 18. Suitable tackle or mechanised methods for this purpose may be incorporated but are not shown. In any translated position, the bridge can then be slewed through a relatively small angle, as shown, in order to align the ship end 32 of the bridge with the loading gate or loading ramp of the ship regardless of the width of the ship.

FIG. 1 also indicates at 70 a position of the ship end 32 in its maximum translated and slewed position to one side.

Bridges of the type so far described have been very successfully employed in a variety of situations but generally project at right angles from the shore, for example, from a quayside and because of their projecting nature, completely block other access to the adjacent part of the quayside.

This problem is alleviated, if not overcome, with the embodiment according to the invention of FIGS. 11 to 14 in which a quayside 100 is shown having a pair of rails 101 for a conventional crane for loding or unloading ships with deck cargo or cargo to be loaded through deck hatches. In addition, the quayside has a recess 104 of the shape shown in FIG. 12. In FIG. 11, a novel form of bridge is shown nested in the recess 104. The bridge is generally indicated at 106. At its shore end, to the right in FIGS. 1 to 14, it is supported by a tubular support 108 attached to the underside of the bridge and resting on a flat plate mounted on a ledge 109 formed at the right-hand end of the recess 104. Thus, a fulcrum is provided which is essentially an inversion of that illustrated in FIG. 2. Buffers corresponding to the buffers 13 and 23 of FIG. 2 are provided, but are not illustrated in FIG. 13. A series of hinged flaps 116 is provided at the shore end of the bridge 106 to bridge the gap between the bridge and the fixed part of the quayside. At its ship end, to the left in FIGS. 11 to 14, the end of the box-like structure of the bridge 106 has an angled face 110, so that when the bridge is slewed outwardly as shown in FIG. 12, this face is generally in line with the stern 112 of a ship 114. FIG. 12 shows the ship 114 as having a stern ramp 115, but it will be understood that, if the bridge is likely to have to handle ships without ramps, retractable flaps such as are shown in FIGS. 8 and 9 can be provided at the ship end of the bridge.

To the left-hand end of the recess 104, a ledge 120 is provided on which the ship end of the bridge 106 can rest when in the stowed position of FIG. 11, and an appropriate mechanism such as a piston and cylinder unit 122 is incorporated to actuate the bridge between its retracted and extended positions. Before the bridge 106 can be moved by means of the unit 122, the buoyancy of its buoyancy tank is adjusted until its ship end is slightly higher than the quay. The bridge can then be swung about its shore end, to move between the positions of FIGS. 11 and 12. After moving the bridge to the position of FIG. 11, the buoyancy of the buoyancy tank is reduced to the minimum by completely flooding the open-bottomed compartment of the tank. In this way, it can be ensured that the buoyancy of the tank and its legs, even at high tide, will not be sufficient to lift the bridge 106 off the ledge 120.

After moving the bridge to the slewed position of FIG. 12, and before adjusting the trim of the bridge to suit the ship to be handled, the piston and cylinder unit 122 is disconnected from the bridge and stowed, since it cannot accommodate large vertical movements of the bridge. If desired, the piston and cylinder unit 122 may be replaced by manually operated mechanisms.

Figure 3:
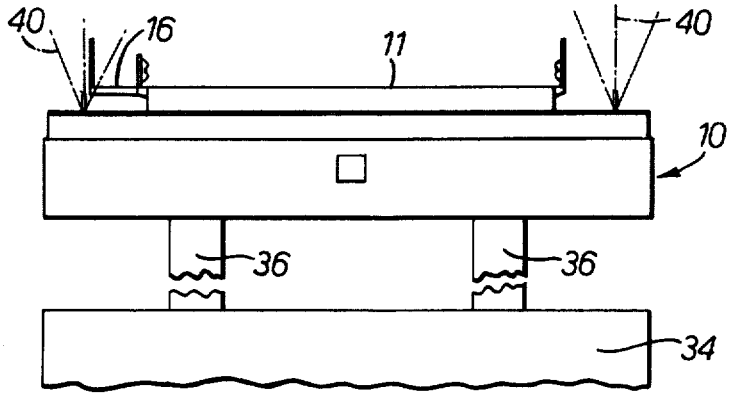
FIG. 3 is an end elevation of the bridge of FIGS. 1 and 2 as viewed from the ship end.

As with the bridge shown in FIGS. 1 to 3, the ship end of the bridge is connected to the ship by cables or chains, shown at 124, while the bridge is in use.

The great advantage of this embodiment of the invention is that the bridge can normally be held in its retracted position of FIG. 11 so as not to obstruct the quayside and to allow ships to berth at any position along the quayside when the bridge, at this position in the quayside, is not required. It may of course, be possible to provide a number of bridges of this type at spaced intervals along the quayside to accommodate ships of different length or at different moored positions or to accommodate a plurality of such ships along one quayside.

As shown in the drawings, it can be arranged that in the stowed position a portion of the rail 101 nearest the quay edge is provided on the bridge itself to provide continuity of the rail 101 in order that a quayside crane can travel over the bridge in its retracted position. At the ship end of the bridge, it should be possible for the gap between the quay and the bridge to be kept small enough that no filler pieces of rail are needed, while at the shore end, continuity of the rail can be provided by removing one of the flaps 116 which lies in the track of the crane wheels, and replacing it with a filler piece of crane rail.

FIG. 14 illustrates how the bridge 106 can also be used to provide vehicular access to a ship having a ramp on the quarter rather than centrally in the stern.

There has thus been shown and described a novel ship to shore bridge which fulfills all the objects and advantages sought therefore. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which do not depart from the spirit and scope of the invention are deemed to be covered by the invention which is limited only by the claims which follow.

What we claim as our invention and desire to secure by Letters Patent is:

1. In a ship to shore bridge of the kind comprising a bridging beam having a ship end, a shore end and two lateral sides, for providing an access track from a shore or quay at said shore end to a water-borne craft at said ship end, said beam being supported at said shore end by a pivotal connection permitting pivoting of said beam around a generally horizontal axis, to enable said ship end of said beam to rise and fall, the improvement comprising providing means for slewing said beam about a substantially vertical axis at said shore end between a stowed position and an operative position, said beam being so dimensioned that when it is in said stowed position it is substantially received in a recess in a quay edge with a side surface of said beam being substantially flush with the side surface of said quay, wherein said ship end of said beam is displaced from said recess when said beam is in said operative position, and wherein said bridging beam has an upper surface which, when said bridging beam is in said stowed position, is flush with the surface of said quay around said recess, thereby permitting normal traffic along said quay over said beam.

2. A bridge according to claim 1 wherein said slewing means comprises a hydraulic piston and cylinder.

3. A bridge according to claim 1, wherein said slewing means comprises a rack and pinion.

4. A bridge according to claim 1 wherein said pivotal connection comprises a circular cross-section bar or tube member co-operating with a planar member, one of said members being permanently located in said recess while the other of said members is secured to the underside of said bridging beam and rests on said one member.

5. A bridge according to claim 4 wherein said circular cross-section bar or tube member is secured to said bridging beam, whereby said horizontal axis of said pivotal connection remains square to the length of said bridge in all positions of said bridge.

6. A bridge according to claim 4 wherein said circular cross-section bar or tube member is fixed to said quay in a position to be square to the length of said bridge when said bridge has been displaced from said stowed position.

7. A bridge according to claim 1, wherein said quay is provided with fixed rails for a crane, said rails extending along said quay, and one of said rails being partially formed on said upper surface of said bridging beam, and connections with the remainder of said rail on said quay being provided at said ends of said beam.

8. A bridge according to claim 1 which also includes a buoyancy tank attached to said ship end of said beam to support said ship end, the buoyancy of said buoyancy tank being adjustable.

9. A bridge according to claim 1 or claim 4 or claim 8 wherein said recess contains a fixed supporting member, said ship end of said beam resting on said fixed supporting member when in said stowed position.

10. A bridge according to claim 1, wherein said bridging beam forms a substantially straight access track from said shore end to said ship end.

11. In a ship to shore bridge of the kind comprising a bridging beam having a ship end, a shore end and two lateral sides, for providing an access track from a shore or quay at said shore end to a water-borne craft at said ship end, said beam being supported at said shore end by a pivotal connection permitting pivoting of said beam around a generally horizontal axis, to enable said ship end of said beam to rise and fall, the improvement comprising providing means for slewing said beam about a substantially vertical axis at said shore end between a stowed position and an operative position, said beam being so dimensioned that when it is in said stowed position it is substantially received in a recess in a quay edge with a side surface of said beam being substantially flush with the side surface of said quay, wherein said ship end of said beam is displaced from said recess when said beam is in said operative position; and providing a buoyancy tank attached to said ship end of said beam to support said ship end, the buoyancy of said buoyancy tank being adjustable, wherein said recess in the quay edge extends over substantially the full height of the quay thereby to accomodate said buoyancy tank within said recess below said bridging beam when said bridging beam is in the stowed position.

* * * * *